US006233910B1

(12) United States Patent
Hataya

(10) Patent No.: US 6,233,910 B1
(45) Date of Patent: May 22, 2001

(54) BINDING MACHINE WITH TAPE

(76) Inventor: Hiroshi Hataya, c/o Taiyo Seiki Co., Ltd., 3-7, Hino 4-chome, Daito-shi, Osaka 574-0062 (JP)

( * ) Notice: Subject to any disclaimer, the term of this patent is extended or adjusted under 35 U.S.C. 154(b) by 0 days.

(21) Appl. No.: 09/356,678

(22) Filed: Jul. 19, 1999

(30) Foreign Application Priority Data

Mar. 10, 1999 (JP) ..... 11-063609

(51) Int. Cl.[7] ..... B65B 13/06

(52) U.S. Cl. ..... 53/589; 53/389.2; 100/8; 100/26; 100/29; 242/597.8

(58) Field of Search ..... 242/597.8, 598.6, 242/591, 592; 100/25, 26, 8, 29; 53/589, 582, 389.2, 587

(56) References Cited

U.S. PATENT DOCUMENTS

| | | | | |
|---|---|---|---|---|
| 2,570,491 | * | 10/1951 | Scardina | 242/597.8 |
| 3,955,491 | * | 5/1976 | McMahon | 100/26 |
| 4,402,467 | * | 9/1983 | Kontz | 242/597.8 |
| 4,661,185 | * | 4/1987 | Kobiella | 53/589 |
| 5,299,407 | * | 4/1994 | Schuttler et al. | 100/29 X |
| 6,085,490 | * | 7/2000 | Buchko | 53/389.2 |

FOREIGN PATENT DOCUMENTS

| | | | | |
|---|---|---|---|---|
| 0 544 066 | | 6/1993 | (EP) . | |
| 0565062 | * | 10/1993 | (EP) | 100/8 |
| 5-65120 | * | 3/1993 | (JP) | 100/8 |
| 10-53209 | | 2/1999 | (JP) . | |

* cited by examiner

*Primary Examiner*—Stephen F. Gerrity
(74) *Attorney, Agent, or Firm*—Rabin & Champagne, PC

(57) ABSTRACT

After a tape is caused to travel in a direction parallel to a front surface of a machine frame to expand a loop, the loop is tightened, to bind a material to be bound. A door which is opened or closed by rotating around an axis of rotation is provided on a side surface of the machine frame. A tape roll is contained in a containing space formed between a reverse surface of the door and a plate opposite thereto, and is held in a holding member. When a binding machine is used upon opening the door, a center line of the tape roll is perpendicular to the direction in which the tape travels, thereby making smooth travel of the tape possible. When the binding machine is not used, the door is closed by rotating around the axis of rotation, to enter a state where it is along the side surface of the machine frame.

7 Claims, 6 Drawing Sheets

BINDING MACHINE WITH TAPE

CROSS REFERENCE TO RELATED APPLICATION

This application claims priority benefits under 35 USC Section 119 of Japanese Patent Application Serial No.11-63609, the disclosure of which is incorporated by reference.

BACKGROUND OF THE INVENTION

1. Field of the Invention

The forward travel of the tape in expanding a small loop to a large loop while pulling the tape out of the tape roll and the backward travel of the tape in tightening the large loop to bind the material to be bound are performed by pressing the surface of the tape against a peripheral surface of the roller which rotates.

At the time of tightening the loop, the tape having a relative amount of length enters a slack state once between the tape roll and the roller.

This type of binding machine is used with it being put on a desk or the like in many cases. In at least a case where the binding machine is not used, it is preferable that the binding machine is as small in size as possible in that a space on the desk can be made effective use of.

From such a relationship that the direction in which the tape travels by the roller is parallel to a front surface of a machine frame, the axis of the tape roll is arranged so as to be perpendicular to the front surface of the machine frame. Generally, the outer diameter of the tape roll (for example, 15 cm) is significantly larger than the width of the tape (for example, 5 cm). Therefore, the machine frame is long in the transverse direction, as viewed from the front, so that the binding machine is increased in size.

Therefore, it is also considered that the tape roll is arranged such that the axis of the tape roll is perpendicular to a side surface of the machine frame. In such a case, however, the tape pulled out of the tape roll is supplied to the roller after the direction thereof is changed by being twisted halfway. Moreover, it is necessary to provide slack to the tape once in a section where twist is necessary between the tape roll and the roller. In order to ensure a good operation of the tape in the section, a tape supporting structure in the section becomes complicated.

SUMMARY OF THE INVENTION

The present invention has been made in view of the above-mentioned problem, and has for its object to provide a binding machine with a tape, whose space can be saved in its simple construction.

In order to attain the above-mentioned object, a preferred mode of the present invention is characterized in that a binding machine with a tape, in which the tape pulled out of a tape roll is caused to travel in a direction parallel to a front surface of a machine frame by roller means respectively having axes perpendicular to the front surface of the machine frame, to bind a material to be bound, comprises a door provided on a side surface of the machine frame and opened or closed by rotating around a predetermined axis of rotation, and tape roll supporting sections for supporting the tape roll on a reverse surface of the door in a state where a center line of the tape roll is perpendicular to the reverse surface of the door, the center line of the tape roll being made parallel to the axes of the roller means by opening the door when the binding machine is used to enter a state where the door is parallel to the front surface of the machine frame.

In this mode, when the binding machine is not used, the door is closed to enter a state where the door is along the side surface of the machine frame, and the tape roll is contained inside the machine frame. Accordingly, the transverse width of the machine frame, as viewed from the front, can be decreased. As a result, it is possible to achieve space saving when the binding machine is not used. On the other hand, when the binding machine is used, the door is opened to enter a state where the door is parallel to the front surface of the machine frame, thereby making the respective centers of the tape roll and the roller means parallel to each other. Consequently, the tape can be caused to smoothly travel by the roller means without particularly providing a complicated tape supporting mechanism between the tape roll and the roller means.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENT

Figure 1:
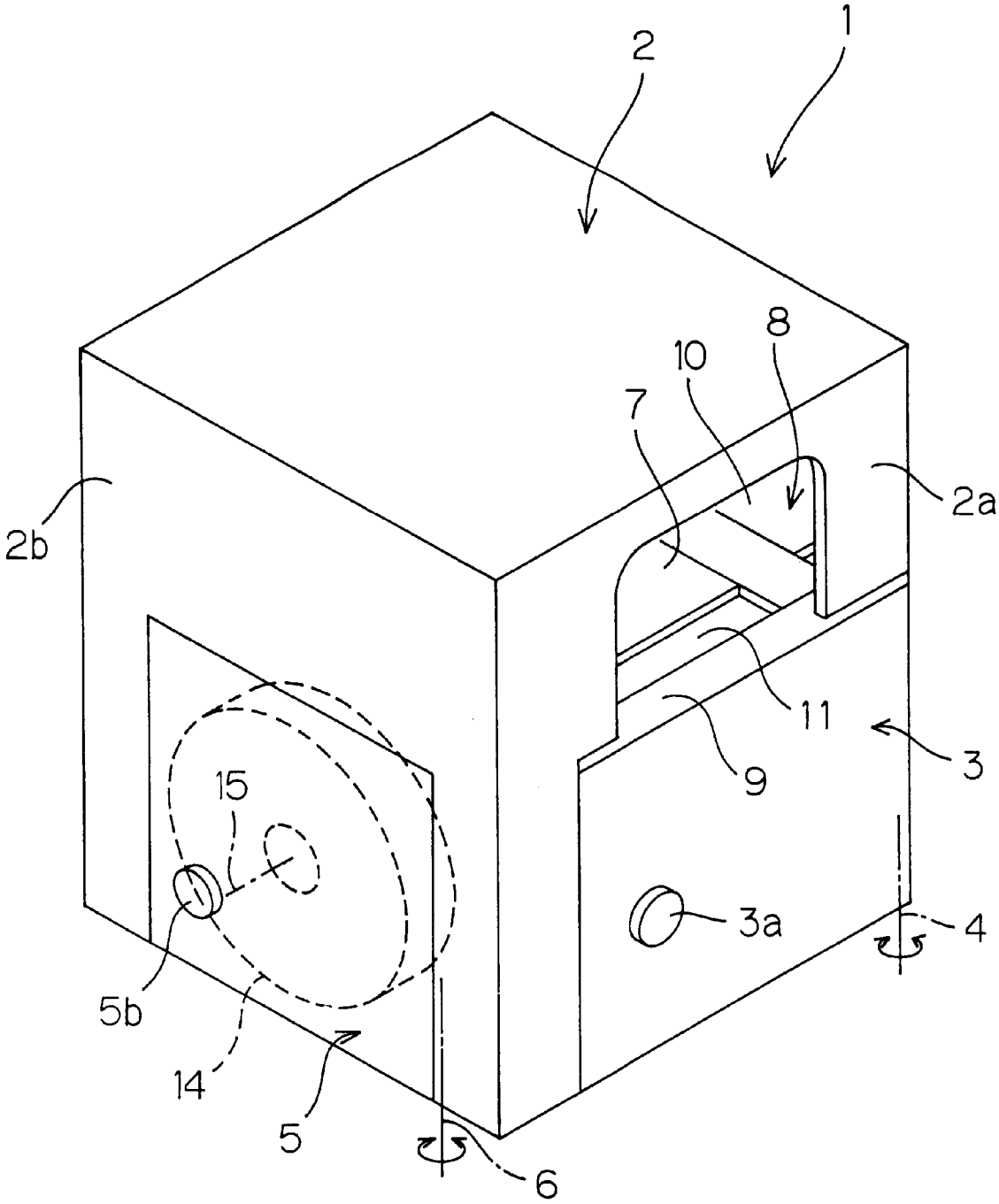
FIG. 1 is a schematic perspective view of a binding machine with a tape according to one embodiment of the present invention in a case where the binding machine is not used.
Figure 2:
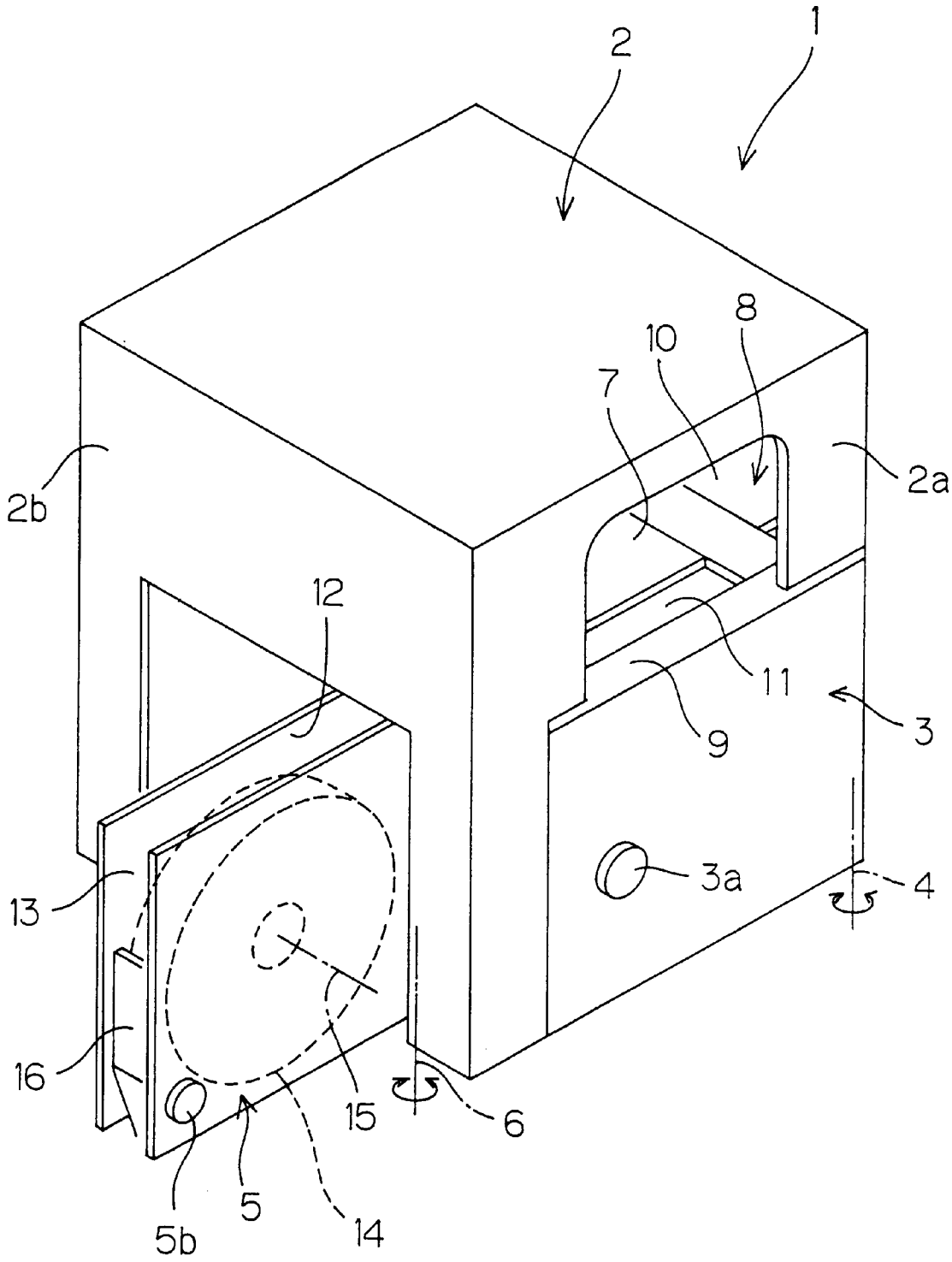
FIG. 2 is a schematic perspective view of the binding machine in a case where the binding machine is used.

A preferred embodiment of the present invention will be described while referring to the accompanying drawings. Referring to FIGS. 1 and 2, a binding machine 1 has its external form constituted by a box-shaped machine frame 2. A front door 3 is provided such that it can be freely opened or closed by rotating around an axis of rotation 4 on a front surface 2*a* of the machine frame 2, and a transverse door 5 is provided such that it can be freely opened or closed by rotating around an axis of rotation 6 on a left side surface 2*b* of the machine frame 2. Although the front door 3 is opened using a knob 3*a* when an end of a tape is set in a traveling mechanism at the time of replacing a tape roll 14 or when the inside of the binding machine is maintained, it generally remains closed.

A window 7 which is opened forward is formed above the front door 3 on the front surface 2*a* of the machine frame 2. A material to be bound is set on a table 8 through the window 7 and is taken out after the binding. The table 8 is divided into a front table 9 and a rear table 10, and a passage groove 11 is formed therebetween. The passage groove 11 is one through which a binding tape passes.

The tape is caused to travel in a direction parallel to the front surface 2*a* of the machine frame 2. The present embodiment is characterized in that the tape roll 14 is contained in a containing space 13 of a roll supporting section formed between a reverse surface 5*a* of the transverse door 5 and a guide plate 12 opposite thereto. The transverse door 5 is opened by 90 degrees, as shown in FIG. 2, only when the binding machine 1 is used, to make the center 15 of the tape roll 14 parallel to an axis of a roller, described later, for causing the tape to travel. The door 5 is closed using a knob 5*b*, as shown in FIG. 1, when the binding machine is not used, to contain the tape roll 14 in the machine frame 2. Reference numeral 16 denotes a holding member for holding the tape roll 14 in the containing space 13. The guide plate 12 and the holding member 16 constitute a tape roll supporting means for supporting the tape roll 14 on the reverse surface 5*a* of the transverse door 5.

Figure 3:
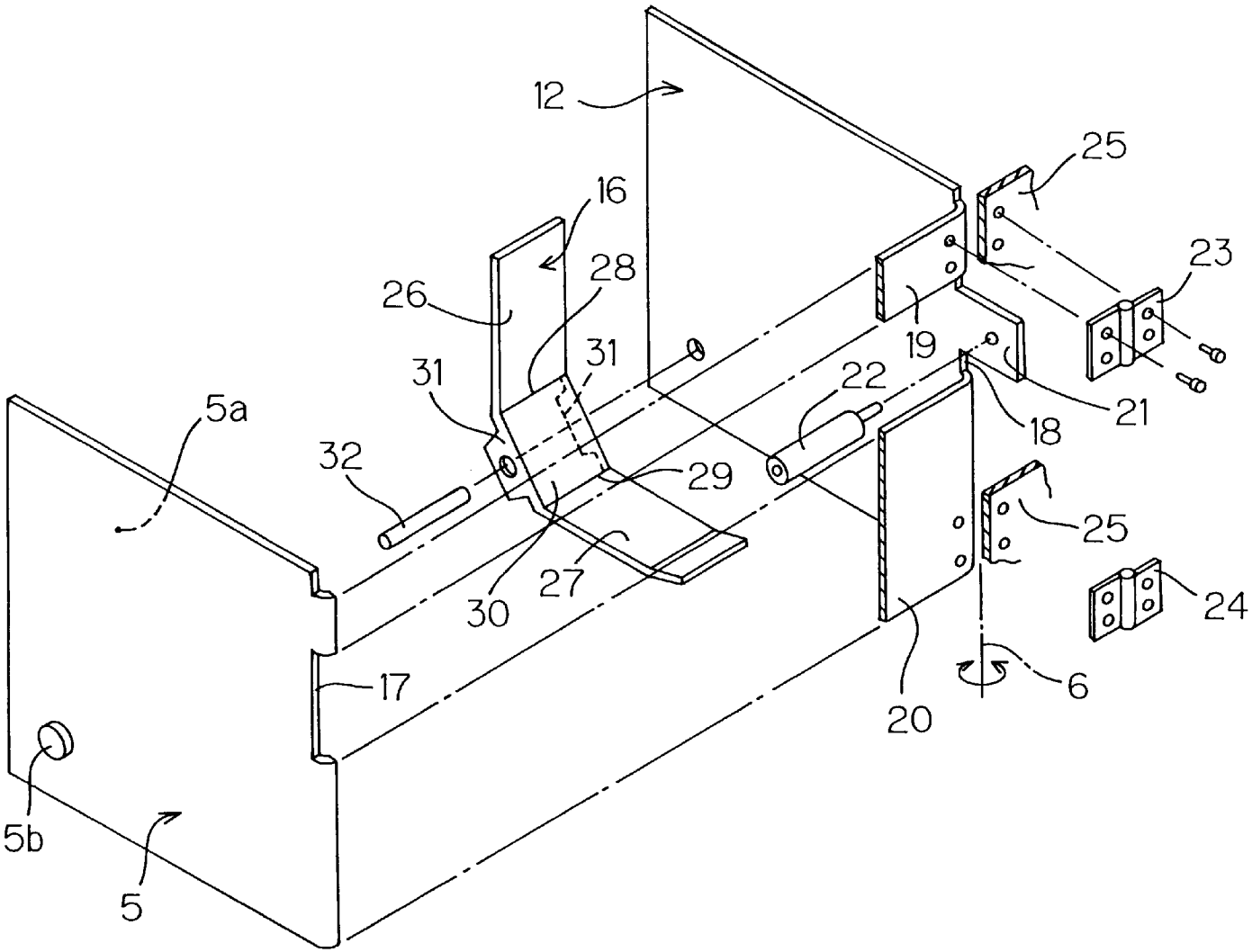
FIG. 3 is an exploded perspective view of a transverse door and its periphery.

Referring now to FIG. 3, the transverse door 5 and the guide plate 12 opposite thereto with predetermined spacing are in a channel shape in cross section as a whole by integrally connecting its edges 17 and 18 near the axis of rotation 6 to each other through a pair of upper and lower connecting sections 19 and 20. A stay 21 extends at the edge 18 of the guide plate 12. The stay 21 supports a guide roller 22 for guiding the travel of the tape. The transverse door 5, the guide plate 12, the connecting sections 19 and 20, and the stay 21 are integrally formed by sheet metal working, thereby reducing costs. Reference numerals 23 and 24 denote hinges, which respectively connect the connecting sections 19 and 20 and a frame 25 in the machine frame 2 to each other so as to be relatively rotatable.

The holding member 16 includes a pair of leaf springs 26 and 27 respectively pressing two different positions on a peripheral surface of the tape roll 14. The leaf springs 26 and 27 have their fixed ends 28 and 29 connected to each other through a connecting member 30. The leaf springs 26 and 27 extend in directions approximately perpendicular to each other, and the connecting member 30 is inclined from both the leaf springs 26 and 27. The connecting member 30 has a pair of flanges 31, and is supported by a supporting shaft 32 penetrating the flanges 31 by the guide plate 12. The holding member 16 is integrally formed by sheet metal working.

The holding member 16 rotates around the supporting shaft 32, to be displaceable to a use position where the tape roll 14 is received in a state where the tape is allowed to be pulled out of the tape roll 14 (see FIGS. 2 and 5) and a replacement position where at least a part of the tape roll 14 is projected outward from the containing space 13 to make the tape roll 14 attachable or detachable. In the use position shown in FIGS. 2 and 5, the leaf spring 27 receives a lower part of the tape roll 14 in a state where an end of the leaf spring 27 is abutted against a stopper 48, and the leaf spring 26 receives a side part of the tape roll 14. Further, the holding member 16 rotates through 90 degrees from the use position shown in FIGS. 2 and 5 to the replace position shown in FIG. 6.

Figure 4:
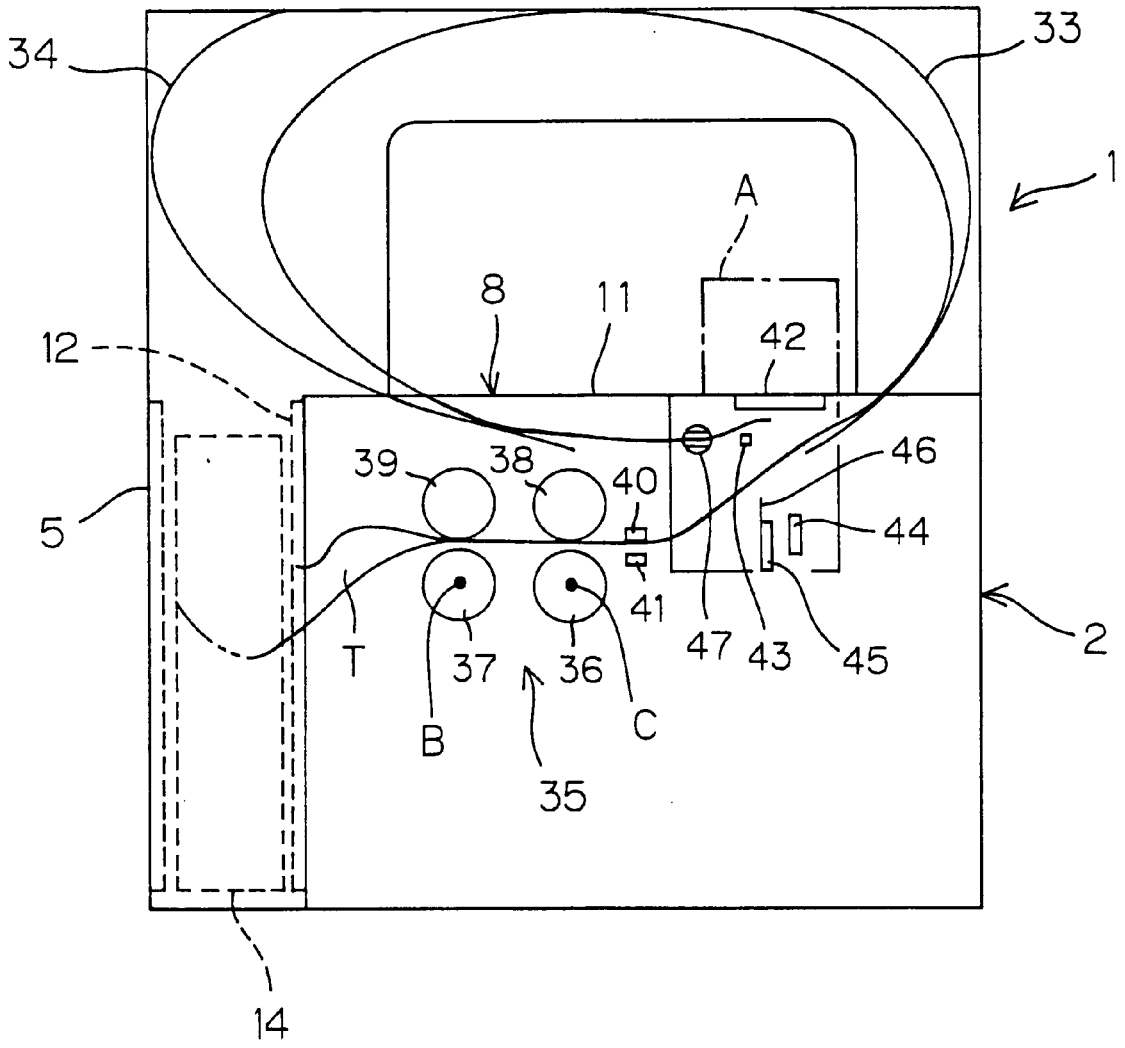
FIG. 4 is a schematic sectional view showing the internal construction of the binding machine in a case where the binding machine is not used.
Figure 5:
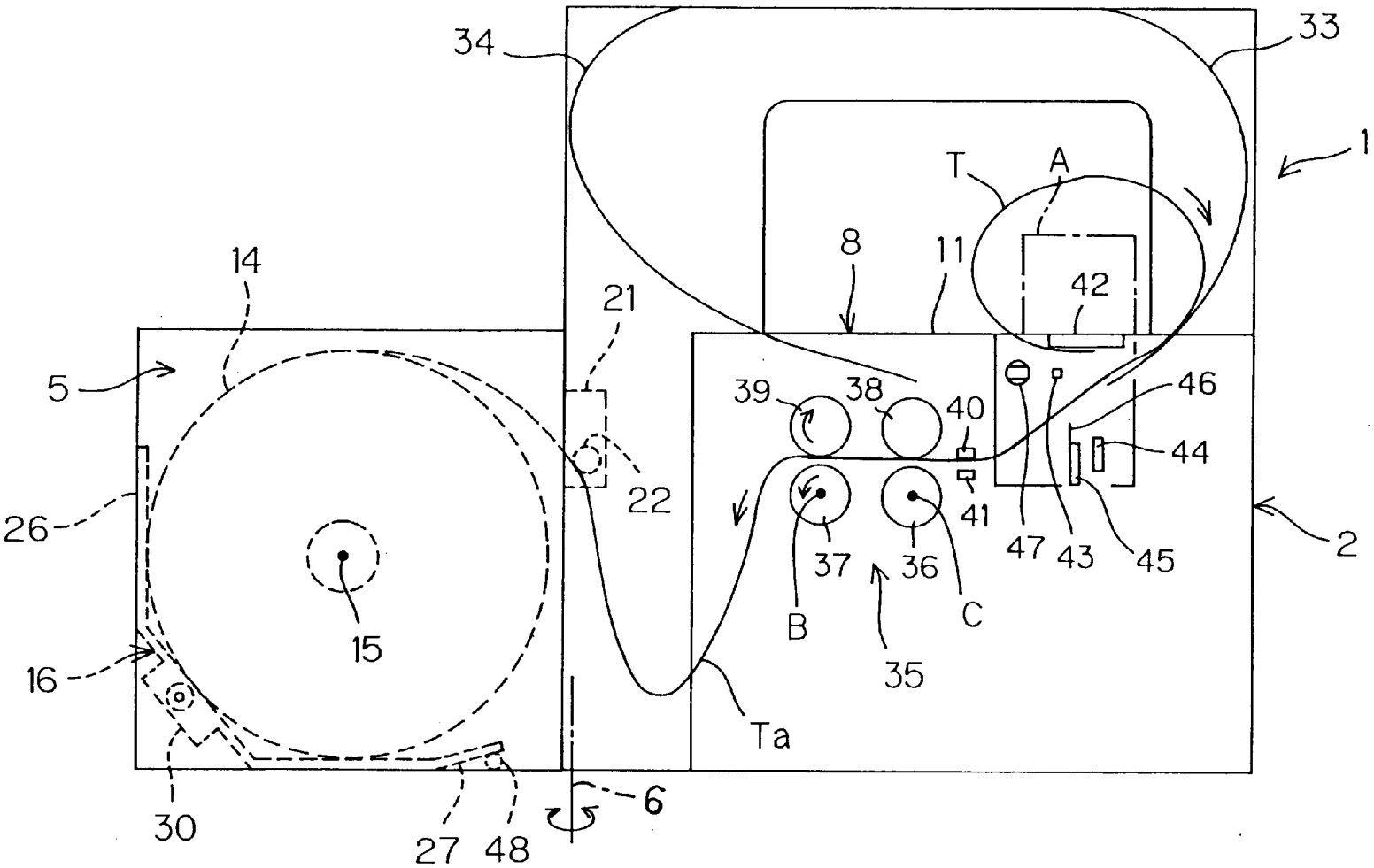
FIG. 5 is a schematic sectional view showing the internal construction of the binding machine in a case where the binding machine is used.
Figure 6:
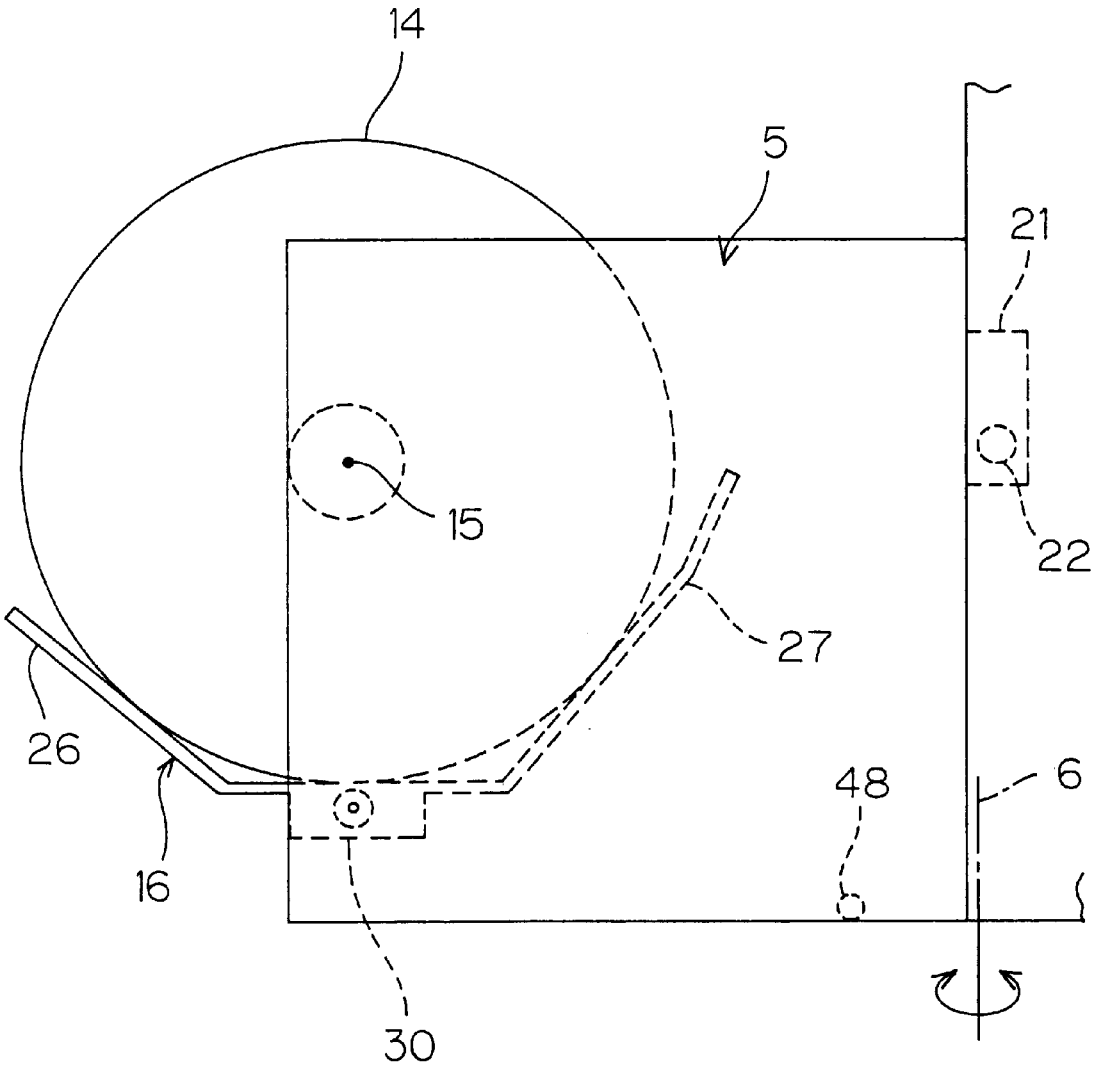
FIG. 6 is a schematic front view of a transverse door showing a state where a holding member for holding a tape roll in a transverse door is displaced to the position where it is attachable or detachable.

Referring now to FIGS. 4 and 5, guide frames 33 and 34 in an arch shape are arranged at both ends of the passage groove 11 above the table 8.

A tape traveling mechanism 35 for delivering and pulling back the tape T is provided below the table 8. The tape traveling mechanism 35 has a delivery roller 36 and a binding roller 37 each composed of a rubber roller. The delivery roller 36 is driven so as to rotate forward (rotate in a clockwise direction), and is used in delivering the tape T toward the guide frame 33 from the tape roll 14. The binding roller 37 is driven so as to rotate in the opposite direction to the delivery roller 16 (rotate in a counterclockwise direction).

Driven rollers 38 and 39 each made of a metal are respectively arranged immediately above the delivery roller 36 and the binding roller 37. The driven rollers 38 and 39 are supported by an inner side plate so as to be alternately abutted against the delivery roller 36 and the binding roller 37 which respectively correspond thereto. That is, when the tape T is delivered from the tape roll 14, the delivery roller 36 and the driven roller 38 are abutted against each other (at this time, the driven roller 39 is spaced apart from the binding roller 37). When the tape T is bound upon being tightened around a material to be bound, the above-mentioned state is reversed, that is, the binding roller 37 and the driven roller 39 are abutted against each other, and the delivery roller 36 and the driven roller 38 separate from each other, as shown in FIG. 3.

A fixed holding member 40 and a movable holding member 41 with the tape T immediately after being delivered from the delivery roller 36 and the driven roller 38 interposed therebetween from above and below are mounted on the downstream side of the delivery roller 36.

As mechanisms provided in the binding machine 1, a receiving plate 42, being movable back and forth, receiving the lower surface of the material to be bound, a first clamping member 43 for clamping a portion a predetermined distance apart from an end of the tape T between the first clamping member and the lower surface of the receiving plate 42, a second clamping member 44 for clamping a winding end portion of the tape T which is overlapped with the end of the tape T between the second clamping member and the lower surface of the receiving plate 42, a heating and pressing section 45 for heating and pressing an overlapped portion of the tape T between both the clamping members 43 and 44, and a cutter 46 elastically supported on the heating and pressing section 45 for cutting the tape T after heating and bonding.

Reference numeral 47 denotes a movable holding member. The movable holding member 47 is constituted by a holding member composed of a pair of leaf springs capable of up-and-down, rotary, and back-and-forth motion with the tape T interposed therebetween. The movable holding member 45 rotates in a state where the end of the tape T is held, to form a small loop of the tape T.

After the small loop is formed, the tape is caused to travel forward in a direction parallel to the front surface 2*a* of the machine frame 2 by the delivery roller 36 having an axis perpendicular to the front surface 2*a* of the machine frame 2, to pull the tape T out of the tape roll 14 to form a large loop, and the material to be bound is then disposed on the table. Thereafter, the tape T is caused to travel backward by the binding roller 37, as shown in FIG. 5, to tighten the loop, thereby binding the material to be bound. When the tape T is tightened, a slack portion Ta of the tape T is smoothly pooled between the tape roll 14 and the binding roller 37 in the tape traveling mechanism 35, to enter a state where the subsequent delivery of the tape is prepared.

In the present embodiment, the transverse door 5 is opened when the binding machine is used, to enter a state where the transverse door 5 is parallel to the front surface 2*a* of the machine frame 2, thereby making the center 15 of the tape roll 14 parallel to axes B and C of the delivery roller 36 and the binding roller 37. Accordingly, the tape can be caused to smoothly travel. As a result, no complicated tape supporting mechanism is particularly provided between the tape roll 14 and the traveling mechanism 35, so that the construction of the binding mechanism can be simplified.

Moreover, when the binding machine is not used, the transverse door 5 is closed, to enter a state where it is along the side surface 2*b* of the machine frame 2, and the tape roll 14 is contained inside the machine frame 2. Therefore, it is possible to reduce the transverse width of the machine frame 2 as viewed from the front, and to achieve space saving in a case where the binding machine is not used.

The tape roll 14 can be simply attached and detached, respectively, only by inserting and extracting the tape roll 14 into and from the containing space 13 between the reverse surface 5*a* of the opened transverse door 5 and the guide plate 12. Accordingly, work for replacing the tape roll 14 is very easy. Further, it is possible to ensure smooth travel of the tape by guiding the tape between the reverse surface 5*a* of the door 5 and the guide plate 12.

Moreover, the tape roll 14 is received while pressing the two different positions on the peripheral surface of the tape roll 14 by the leaf springs, so that the tape roll 14 can be reliably held. Further, the tape roll 14 can be easily displaced to the use position and the tape roll replacement position by rotating the holding member 14, resulting in good workability.

The present invention is not limited to the above-mentioned embodiment. For example, when the holding member is displaced to the use position and the tape roll replacement position, the holding member may be slid in a direction parallel to the reverse surface of the door, although the holding member is rotated in the present embodiment. In addition thereto, the present invention can be subjected to various changes.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A binding machine, comprising:

a machine frame;

roller means disposed in said machine frame, tape being pullable out of a tape roll and being caused to travel in a direction parallel to a front surface of the machine frame by said roller means to bind a material to be bound, said roller means respectively having axes perpendicular to the front surface of the machine frame;

a door provided on a side surface of the machine frame and being opened or closed by rotating around a predetermined axis of rotation; and tape roll supporting means for supporting the tape roll on a reverse surface of the door in a state where a center line of the tape roll is perpendicular to the reverse surface of the door, the center line of the tape roll being made parallel to the axes of the roller means by opening the door, when the binding machine is used, to enter a state where the door is parallel to the front surface of the machine frame, wherein the tape roll supporting means comprises a plate mounted on the door so as to be integrally rotatable therewith, opposed to the reverse surface of the door with predetermined spacing, and defining a containing space containing the tape roll between the plate and the reverse surface of the door, and holding means for holding the tape roll in the containing space and for slidably receiving a peripheral surface of the tape roll, the holding means being displaceable to a use position where the tape roll is received in a state where the tape is allowed to be pulled out of the tape roll, and a tape roll replacement position where at least a part of the tape roll is projected outward from the containing space to make the tape roll attachable or detachable.

2. The binding machine with the tape according to claim 1, wherein the door and the plate are integrally formed by sheet metal working.

3. The binding machine with the tape according to claim 1, wherein a rotation of the tape roll is guided by the reverse surface of the door and the plate.

4. The binding machine with the tape according to claim 1, wherein the holding means comprises a pair of leaf springs for respectively pressing two different positions on the peripheral surface of the tape roll, and a connecting member, being displaceable, for connecting respective fixed ends of the pair of leaf springs to each other, the connecting member being displaced, to displace the holding means to the use position and the tape roll replacement position.

5. The binding machine with the tape according to claim 4, wherein the connecting member is rotatable around a supporting shaft supported on at least one of the door and the plate.

6. The binding machine with the tape according to claim 4, wherein the pair of leaf springs and the connecting member are integrally formed by sheet metal working.

7. The binding machine with the tape according to claim 1, wherein the roller means causes the tape to travel in a first direction parallel to the front surface of the machine frame to expand a loop formed by the tape, and causes the tape to travel in a second direction opposite to the first direction to tighten the loop, to bind the material to be bound.

* * * * *